US005497948A

United States Patent [19]

Hockmeyer

[11] Patent Number: 5,497,948

[45] Date of Patent: Mar. 12, 1996

[54] BASKET MEDIA MILL WITH EXTENDED IMPELLER

[75] Inventor: Herman H. Hockmeyer, Saddle River, N.J.

[73] Assignee: Hockmeyer Equipment Corp., Harrison, N.J.

[21] Appl. No.: 442,397

[22] Filed: May 16, 1995

[51] Int. Cl.[6] ..... B02C 17/02

[52] U.S. Cl. ..... 241/46.17; 241/74; 241/172; 241/199.12

[58] Field of Search ..... 366/263, 264; 241/46.11, 46.17, 172, 199.12, 74

[56] References Cited

U.S. PATENT DOCUMENTS

| | | | |
|---|---|---|---|
| 2,390,579 | 12/1945 | Fritzberg | 366/263 X |
| 5,184,783 | 2/1993 | Hockmeyer et al. | 241/172 X |
| 5,346,147 | 9/1994 | Ishikawa et al. | 241/172 |

FOREIGN PATENT DOCUMENTS

| | | | |
|---|---|---|---|
| 174230 | 10/1983 | Japan | 241/172 |
| 210020 | 8/1989 | Japan | 241/172 |
| 1158228 | 5/1985 | U.S.S.R. | 241/74 |

*Primary Examiner*—Mark Rosenbaum
*Assistant Examiner*—Adrian Coley
*Attorney, Agent, or Firm*—Samuelson & Jacob

[57] ABSTRACT

A media basket mill for dispersing a selected constituent into a liquid vehicle to produce a mixture of the constituent and the liquid vehicle within a mixing vessel includes a basket extending in an axial direction between a upper end and a lower end, a media bed in the basket, and an impeller, the basket having a wall for retaining the media bed within the basket and openings in the wall for permitting passage of the mixture through the wall in response to operation of the impeller when the basket is immersed in the mixture in the vessel, the wall including a bottom wall portion at the lower end and an axially extending side wall portion having an overall diametral dimension, the openings being located at least in the side wall portion, the impeller including a rotor mounted for rotation about the axial direction, and impeller blades on the rotor, the impeller blades having at least blade portions located radially outwardly beyond the diametral dimension of the side wall portion of the wall of the basket for assisting in the movement of the mixture through the openings in the side wall portion and in enhancing movement of the mixture within the mixing vessel, outside the basket, in response to rotation of the rotor.

28 Claims, 4 Drawing Sheets

BASKET MEDIA MILL WITH EXTENDED IMPELLER

The present invention relates generally to the dispersion of selected constituents into liquids and pertains, more specifically, to an improvement in basket media mills in which a solid constituent is finely divided and dispersed in a liquid vehicle, as in the manufacture of paints, coatings, inks and like products.

In an earlier patent, U.S. Pat. No. 5,184,783, the disclosure of which is incorporated herein by reference thereto, there are described basket media mills of the type in which a basket containing a bed of grinding media is immersed in a mixture of liquid and solids to be dispersed in the liquid, held within a vessel, and at least one impeller moves the mixture through the basket, and through the bed of media in the basket, to circulate the mixture in the vessel and divide and disperse the solids within the liquid vehicle.

The present invention provides an improvement in basket media mills of the type described above, which improvement attains several objects and advantages, some of which are summarized as follows: Increases the rate at which the mixture is circulated through the basket, and through the bed of media in the basket, for more rapid grinding and dispersion of the solids in the liquid; enhances the ability to circulate higher viscosity mixtures; attains the dispersion of more finely divided solids in a liquid vehicle in less time; increases agitation of the mixture within the mixing vessel, outside the basket, for improved homogeneity of the mixture; enables effective grinding and dispersion of solids which heretofore have resisted efficient grinding and mixing with liquids; increases the efficiency with which solids are finely divided and dispersed in a liquid vehicle, thereby reducing energy requirements; attains mixtures of enhanced and uniform quality with less processing time; enhances the ability to incorporate dry materials into the mixture without requiring additional pre-wetting or pre-mixing; reduces clogging and other detrimental effects, thereby attaining more effective operation; increases the service life of the apparatus through reduced wear and either the reduction or elimination of other deleterious conditions.

The above objects and advantages, as well as further objects and advantages, are attained by the present invention which may be described briefly as providing an improvement in a media basket mill for dispersing a selected constituent into a liquid vehicle to produce a mixture of the constituent and the liquid vehicle within a mixing vessel, the media basket mill including a basket extending in an axial direction between a upper end and a lower end, a media bed in the basket, and impeller means, the basket having a wall for retaining the media bed within the basket and openings in the wall for permitting passage of the mixture through the wall in response to operation of the impeller means when the basket is immersed in the mixture in the vessel, the wall including a bottom wall portion at the bottom end and an axially extending side wall portion having an overall diametral dimension, the openings being located at least in the side wall portion, wherein: the impeller means includes a rotor for rotation about the axial direction, and impellers on the rotor, the impellers being located radially outwardly beyond the diametral dimension of the side wall portion of the wall of the basket for assisting in the movement of the mixture through the openings in the side wall portion and within the mixing vessel outside the basket in response to rotation of the rotor.

The invention will be understood more fully, while still further objects and advantages will become apparent, in the following detailed description of preferred embodiments of the invention illustrated in the accompanying drawing, in which:

FIG. 1 is a diagrammatic longitudinal cross-sectional view of a basket media mill constructed in accordance with the present invention;

FIG. 2 an enlarged fragmentary view of a portion of the basket media mill of FIG. 1;

Figure 1:
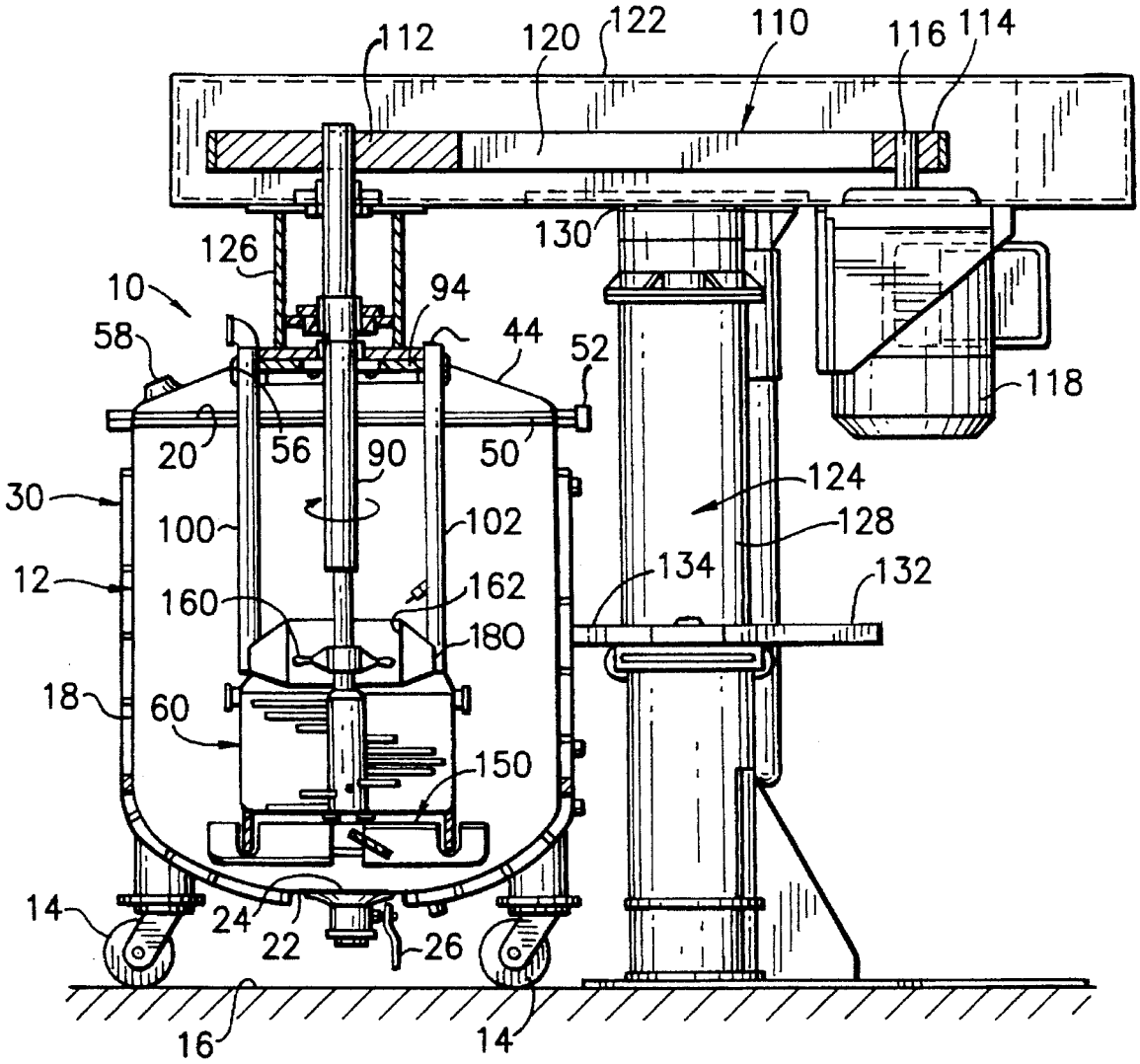
Figure 2:
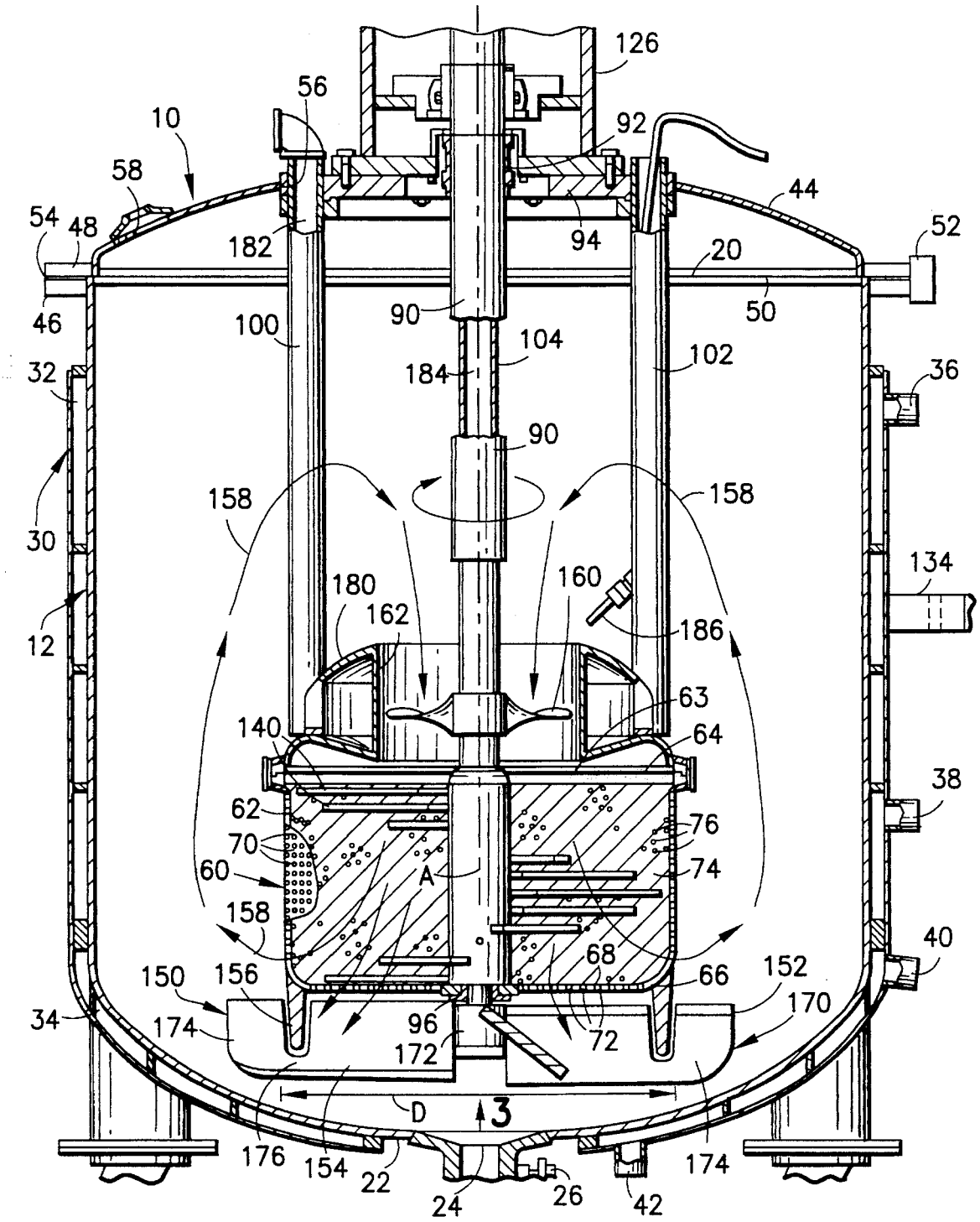

Referring now to the drawing, and especially to FIGS. 1 and 2 thereof, a basket media mill constructed in accordance with the present invention is illustrated generally at 10. Basket media mill 10 includes a generally cylindrical mixing vessel 12 supported on casters 14 for movement along a flat surface 16, such as the floor of a manufacturing plant. Vessel 12 includes a wall 18 which extends axially from an upper end 20 to a lower end 22 of the vessel 12, and the vessel 12 is provided at the lower end 22 with an outlet port 24 and a valve 26 through which the contents of the vessel 12 can be drained as desired.

A cooling jacket 30 surrounds most of the side wall 18 and is divided into an upper section 32 and a lower section 34. Upper section 32 includes an inlet 36 for the introduction of a coolant, usually water, to be circulated in the upper section 32, and an outlet 38 for the removal of the circulated coolant. Likewise, the lower section 34 includes an inlet 40 and an outlet 42 for enabling circulation of a coolant through the lower section 34. Cooling jacket 30 is of a conventional construction and is provided in order to cool the materials being processed within the vessel 12, since the grinding and mixing operation tends to heat the contents of the vessel 12.

A removable cover 44 optionally is placed over the upper end 20 of the vessel 12. A first securing flange 46 is provided along the periphery of the upper end 20 of the vessel 12 and a second securing flange 48, complementary to the first securing flange 46, is provided along the corresponding periphery of the lower end 50 of the cover 44. When cover 44 is positioned on the upper end of vessel 12, flanges 46 and 48 are secured together by a clamp 52. In addition, a seal 54 may be provided between vessel 12 and cover 44 to prevent the escape of any contents of the vessel 12. Cover 44 is provided with a central opening 56, for purposes which will be described below. It is noted that the inclusion of cover 44 is optional, and the basket media mill 10 may be operated without a cover 44, depending upon the nature of the materials being processed in the vessel 12. When the cover 44 is in place, the materials to be processed in the vessel 12 are delivered through an inlet port 58 in the cover 44. When no cover is employed, the materials to be processed merely are poured into the vessel 12 through the open upper end 20 of the vessel 12.

Figure 3:
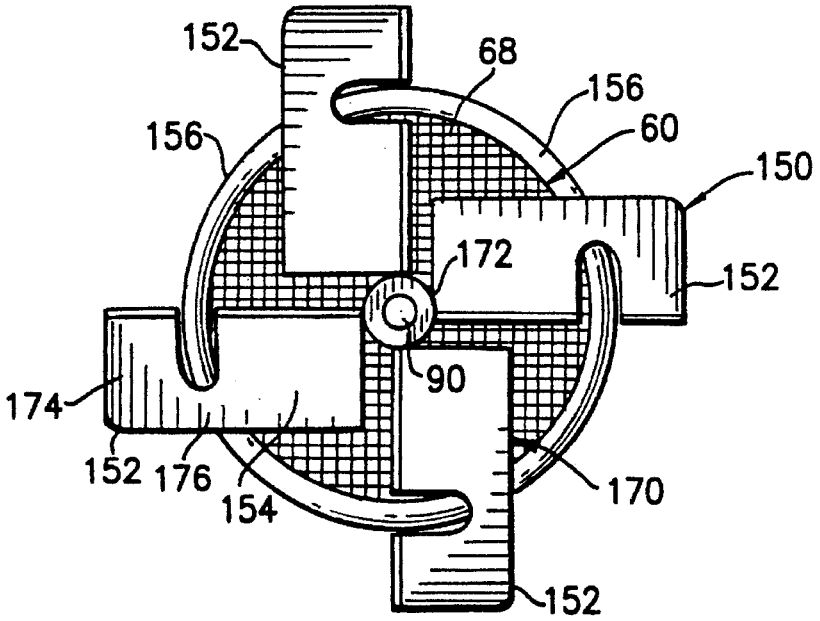
FIG. 3 is a bottom plan view of the basket media mill, taken in the direction of the arrow in FIG. 2.

A basket 60 is selectively inserted into the vessel 12 so as to be immersed in the contents of the vessel 12. As best seen in FIGS. 2 and 3, as well as in FIG. 1, basket 60 has a generally cylindrical configuration and includes a cylindrical side wall 62 having an overall diametral dimension in the form of overall diameter D and extending axially from an entrance 63, at upper end 64, to a lower end 66. A bottom wall 68 spans the lower end 66 of the basket 60. The cylindrical side wall 62 of the basket 60 is constructed of a grid-like material having openings shown in the form of axial slots 70 passing radially through the side wall 62. Similar openings in the form of further slots 72 extend axially through the bottom wall 68. A media bed 74 is placed in the basket 60 and preferably is in the form of a mass of discrete media elements illustrated as beads 76. The relative dimensions of the beads 76 and the slots 70 and 72 are such that the media bed 74 is retained in the basket 60. That is, the lateral width of the slots 70 and 72 is no greater than the minimum diameter of the beads 76. In the preferred arrangement, the lateral width of the slots 70 and 72 is approximately one-third the minimum diameter of the beads 76 within the basket 60 so as to facilitate the flow of the contents of vessel 12 through the basket 60 while preventing the escape of beads 76 from the basket 60. As an example, beads 76 can have a diameter within the range of 0.25 mm to 4.0 mm and can be made of any suitable material, such as glass, ceramic, plastic, metal or any other high density material.

A drive shaft 90 extends axially through the basket 60 and is journaled for rotation relative to the basket 60 within an upper bearing 92 carried by a support plate 94 fitted into and sealing the central opening 56 in the cover 44 and a lower bearing 96 in the bottom wall 68 of the basket 60. Columns 100, 102 and 104 (column 104 being partially hidden behind the drive shaft 90 in FIGS. 1 and 2) interconnect the basket 60 with the support plate 94 and mount the basket 60 in a secure, fixed position within the vessel 12 when the support plate 94 is fitted appropriately into the central opening 56 and the cover 44 is clamped in place on the vessel 12. A drive train 110 includes a first pulley 112 affixed to the upper end of the drive shaft 90, a second pulley 114 secured to the output shaft 116 of a drive motor 118, and a drive belt 120 coupling the first and second pulleys 112 and 114 so that operation of the drive motor 118 will rotate the drive shaft 90 about the central axis A of the drive shaft 90. Drive motor 118 is carried by an arm 122 of a main frame 124 and the arm 122 is affixed to support plate 94 through a connecting member 126.

Main frame 124 includes a vertical standard 128 which extends between the flat surface 16 and the arm 122. Arm 122 is mounted upon a vertically movable hydraulic lift 130 located within the vertical standard 128. Vessel 12 is held in place relative to the vertical standard 128 by means of a clamp assembly 132 carried by the vertical standard 128 and detachably secured to the vessel 12 at 134. When it is desired to withdraw basket 60 from vessel 12, clamp 52 is released so as to enable separation of the first and second securing flanges 46 and 48 and concomitant release of the cover 44 from the vessel 12. Hydraulic lift 126 is actuated to raise the main frame 122, along with the cover 44 and the support plate 94, and the basket 60 is withdrawn from vessel 12. In this manner the basket 60 selectively is removed from the vessel 12 and, upon releasing the clamp assembly 132, the vessel 12 can be moved to another station. Should it be desired to clean the basket 60 and the media bed 74 therein, a further vessel, similar to vessel 12, may be placed beneath the basket 60 and the basket 60 may be lowered into a bath of solvent in the further vessel. Operation of the drive motor 118 then will rotate the drive shaft 90 to effect cleaning of the basket 60 and the corresponding component parts, some of which now will be described in greater detail.

As best seen in FIG. 2, a plurality of stirring rods 140 are carried by the drive shaft 90 and extend radially outwardly from the drive shaft 90 into the media bed 74. Stirring rods 140 are arranged in a spiral array axially along the drive shaft 90. During rotation of the stirring rods 140 with drive shaft 90, the beads 76 are caused to move with a random up and down motion, rather than moving as a mass only in a rotational motion, and the desired shearing or grinding action is enhanced. Additionally, any tendency toward packing of the media bed 74 and clogging of the slots 70 and 72 is reduced. Generally speaking, approximately ninety percent of the mixing accomplished within the basket media mill 10 takes place within the basket 60.

In order to circulate the mixture through the basket 76, means including an impeller assembly 150 is coupled for rotation with the drive shaft 90 at the lower end of the drive shaft 90, below and closely adjacent to the bottom wall 68 of the basket 60. Impeller assembly 150 includes impellers in the form of impeller blades 152, each having an inner impeller blade portion 154 which rotates within a cylindrical shroud 156 affixed to and depending from the lower end 66 of the side wall 62 of the basket 60, the shroud 156 having an outer diameter about the same as the diametral dimension of the side wall 62 of the basket 60 and an inner diameter only slightly greater than the overall diameter of the inner impeller blade portions 154. Impeller blade portions 154 establish a pressure differential axially across the impeller assembly 150 which induces circulation of the mixture along a circuit within the vessel 12, as depicted by the arrows 158 in FIG. 2, the circuit passing through the basket 60, with the mixture exiting the basket 60 through both the side wall 62 and the bottom wall 68.

As an example of the dimensions in a preferred embodiment of the present invention, the inner diameter of vessel 12 is about forty-two inches, the inner diameter of basket 60 is about sixteen inches and the vertical height of the basket 60 is about twenty inches. Inner impeller blade portions 154 have an overall diameter almost as great as the inner diameter of the shroud 156, and drive shaft 90 is rotated at a maximum speed of about five-hundred rpm. Thus, the maximum speed at the tip of the inner impeller blade portions 154 is approximately twenty-one-hundred feet per minute, although the speed can be varied depending upon the viscosity of the mixture in the vessel 12.

In the dispersion of pigment into a liquid vehicle, rotation of the drive shaft 90 rotates the impeller assembly 150 which, in turn, causes movement of the mixture of pigment and the liquid vehicle along the circuit depicted by the arrows 158. The liquid vehicle and pigment thus are caused to flow through the basket 60 and through the media bed 74 in the basket 60. At the same time, the stirring rods 140 cause movement of the beads 76 which interacts with the pigment to produce a shearing action between the pigment and the beads 76 and breaks down the pigment into fine particles. The fine particles are dispersed in the liquid vehicle to produce a uniform mixture.

A second or upper impeller assembly 160 is coupled to drive shaft 90 at the upper end of basket 60, adjacent the entrance 63 to the basket 60, for rotation with the drive shaft 90. The upper impeller assembly 160 rotates within an upper tubular shroud 162 which closely surrounds the impeller assembly 160. Rotation of the impeller assembly 160 establishes a pressure differential axially across the impeller assembly 160, raising the pressure at the entrance 63 to the basket 60. The two impeller assemblies 150 and 160 are operated to attain a balanced pressure differential axially across the basket 60 for enhanced flow of the mixture through the basket 60, while assisting in the appropriate agitation of the beads 76 in the media bed 74 for optimum grinding and dispersion of the pigment within the liquid vehicle.

It has been found that the volumetric flow rate, or throughput, of the mixture through the basket 60, and through the media bed 74 in the basket 60, can be increased to attain a concomitant increase in the grinding and mixing rate and, consequently, a decrease in the time needed to complete the dispersion of more finely divided solids into the liquid vehicle, by providing impeller assembly 150 with further means which assist in the movement of the mixture through the side wall 62. As best seen in FIGS. 2 and 3, impeller assembly 150 includes a rotor 170 coupled with drive shaft 90 for rotation therewith about central axis A, rotor 170 having a hub 172 which carries the impeller blades 152, the number of impeller blades 152 preferably being at least two, with the number of impeller blades 152 in the illustrated embodiment being four. Each impeller blade 152 includes an impeller in the form of inner blade portion 154 extending radially between the hub 172 and the shroud 156, and a further impeller in the form of an outer blade portion 174 extending radially beyond the shroud 156. Each inner blade portion 154 is juxtaposed with the bottom wall 68 so as to assist in the movement of the mixture through the slots 72 in the bottom wall 68, as described above, and is within the diametral dimension of the side wall 62. Each outer blade portion 174 extends radially beyond the diametral dimension of the side wall 62. A web 176 bridges the inner blade portion 154 and the outer blade portion 174 of each impeller blade 152 so that the shroud 156 is interposed between the inner blade portion 154 and the outer blade portion 174, with the outer blade portions 174 extending radially outwardly to assist in circulating the mixture and in movement of the mixture to increase the volumetric flow through the slots 70 in the side wall 62. The pitch of the outer blade portions 174 can be selected independent of the pitch of the inner blade portions 154 to optimize the flow of the mixture in the mixing vessel 12 and better accommodate the viscosity of the particular mixture being processed. Thus, the pitch of outer blade portions 174 can be adjusted by twisting of the web 176, or by another adjusting arrangement for selectively varying the pitch of the outer blade portions 174 on the rotor 170. Likewise, the pitch of the inner blade portions 154 may be made selectively adjustable independent of the pitch of the outer blade portions 174. The improved flow of the mixture in the mixing vessel 12, outside the basket 60, as attained by the outer blade portions 174, further improves the homogeneity of the mixture in the vessel 12. The improved homogeneity enhances movement of the mixture along the circuit through the vessel 12 and the basket 60. Further, movement of the mixture by the outer blade portions 174 increases agitation within the vessel 12, outside the basket 60, and impedes adherence of material to the side wall 18 of the vessel 12, thereby reducing the need for periodic scraping of the side wall 18, with a concomitant reduction in maintenance requirements.

As a result of the increased volumetric flow, the rate of grinding and mixing is increased and there may tend to be a rise in the temperature within the mixture being processed. In order to guard against any degradation which might ensue from a temperature rise in the processed mixture, a cooling collar 180 is provided around the outer periphery of the upper shroud 162 at the upper end 64 of the basket 60 to further control the temperature of the mixture being processed. An input coolant passage 182 extends through column 100 and interconnects cooling collar 180 with a supply of coolant (not shown), such as water, and an output coolant passage 184 extends through column 104 to connect the cooling collar 180 with the supply of coolant and complete a coolant circuit. As a result, the mixture flowing past the upper impeller 160 is cooled by the cooling collar 180 in order to reduce the temperature of the mixture being processed. A temperature probe 186 senses the temperature of the mixture and provides a signal for controlling the flow of coolant from the supply to the cooling collar 180. Alternately, where it is desired to increase the temperature of the mixture being processed, a heated fluid may be circulated through the collar 180.

Figure 4:
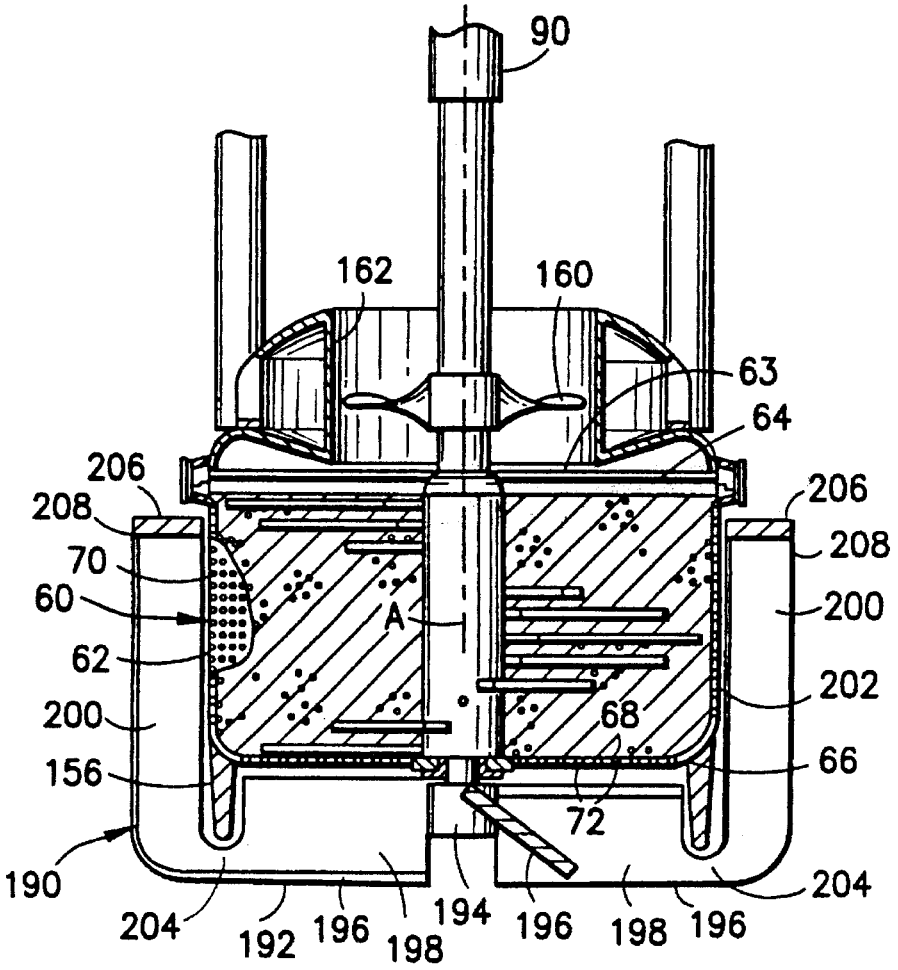
FIG. 4 is a fragmentary view similar to FIG. 2, but showing another embodiment of the invention.

In the embodiment of FIG. 4, an impeller assembly 190 replaces the impeller assembly 150 of the embodiment described above in connection with FIGS. 1 through 3, impeller assembly 190 also including a rotor 192 coupled with drive shaft 90 for rotation therewith about central axis A, the rotor 192 having a hub 194 carrying a plurality of impeller blades 196 radiating from the hub 194, the preferred number of impeller blades 196 being at least two, with four being illustrated. Each impeller blade 196 includes an inner blade portion 198 juxtaposed with the bottom wall 68 and extending radially between the hub 194 and the shroud 156, within the diametral dimension of the side wall 62, to assist in moving the mixture through the slots 72 in the bottom wall 68, as described above. Each impeller blade 196 further includes an outer blade portion 200 extending radially beyond the shroud 156, and radially beyond the diametral dimension of the side wall 62, as before. However, outer blade portions 200 each extend in an axial direction, preferably generally parallel to the central axis A, to be juxtaposed with the outer surface 202 of the side wall 62 along at least a major portion of the axial extent of the side wall 62, and preferably along the side wall 62 from adjacent the lower end 66 of the basket 60 to adjacent the upper end 64 of the basket 60. A web 204 bridges the inner and outer blade portions 198 and 200 of each impeller blade 196 and maintains the outer blade portions 200 in the desired juxtaposition with the side wall 62. An annular brace 206 is affixed across the upper tips 208 of the outer blade portions 200, as by welding, to add rigidity to the impeller assembly 190 and maintain the appropriate relationship between the outer blade portions 200 and the side wall 62. That relationship, wherein the outer blade portions 200 are located within relatively close proximity to the side wall 62, enables a significant increase in volumetric flow of the mixture through the slots 70 in the side wall 62 as the impeller assembly 190 rotates about central axis A.

Figure 5:
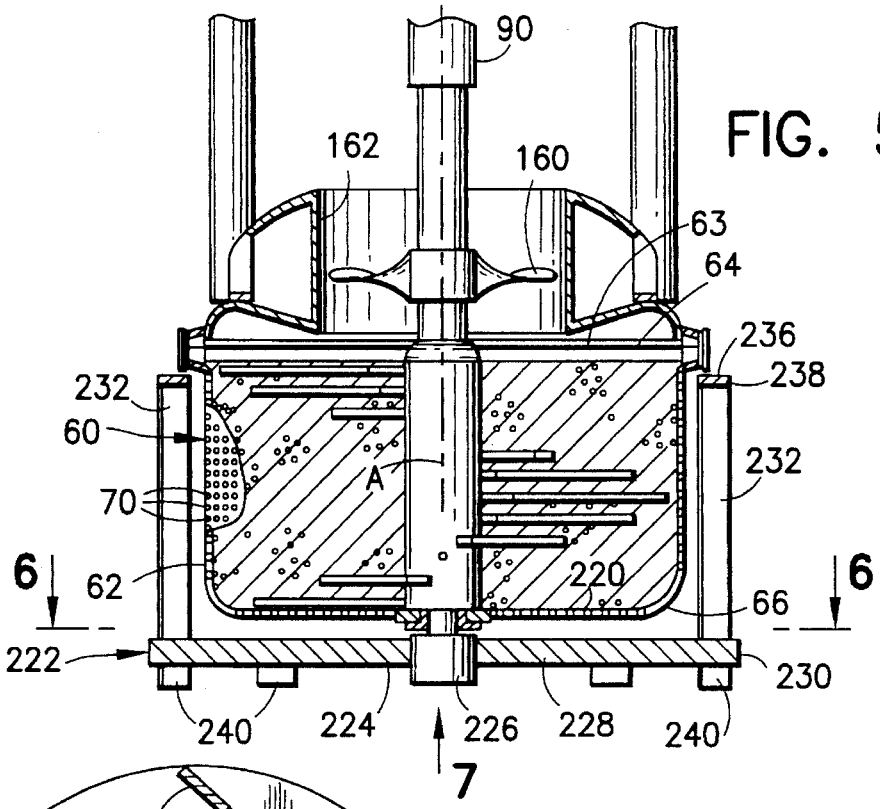
FIG. 5 is a fragmentary view similar to FIG. 2, but showing a further embodiment of the invention.
Figure 6:
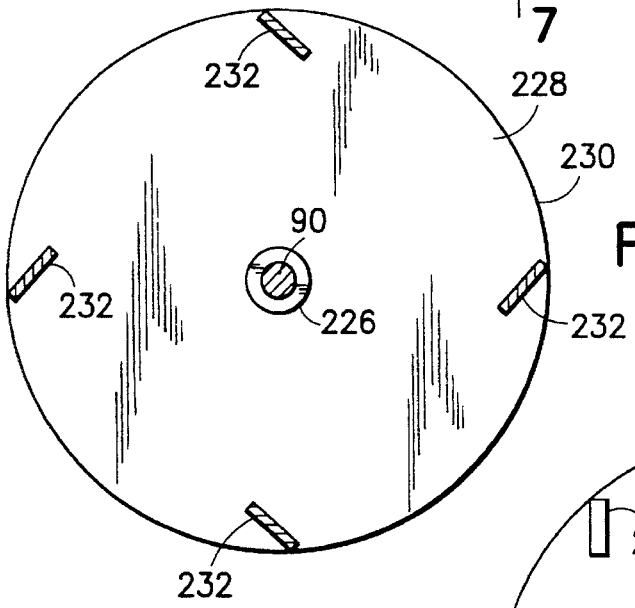
FIG. 6 is a lateral cross-sectional view taken along line 6—6 of FIG. 5.
Figure 7:
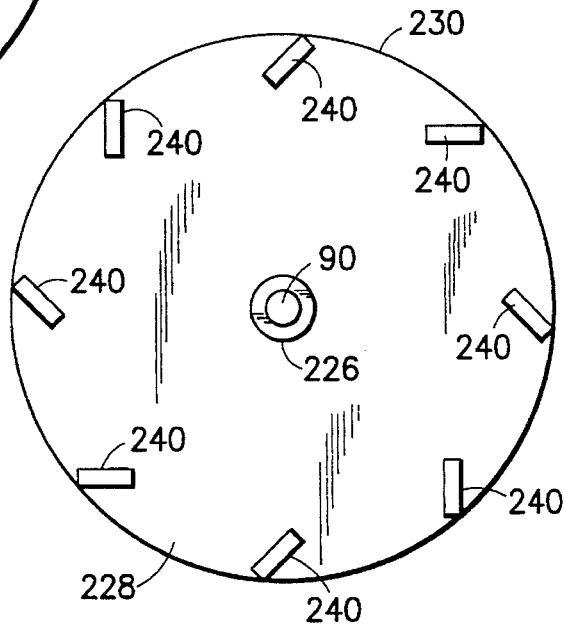
FIG. 7 is a bottom plan view taken in the direction of the arrow in FIG. 5.

Turning now to FIGS. 5 through 7, in a further embodiment of the present invention, bottom wall 220 of basket 60 is essentially imperforate; that is, there are no openings corresponding to slots 72 of the previously-described embodiments of FIGS. 1 through 4. Thus, all of the throughput of the circulating mixture passes through the slots 70 in the side wall 62. Impeller assembly 222 includes a rotor 224 having a hub 226 and a disk-like member 228 extending radially from the hub 226, beneath the bottom wall 220 of the basket 60, to an outer periphery 230 located radially outside the diametral dimension of the side wall 62 of basket 60.

A plurality of impeller blades 232, preferably at least two and shown four in number, are affixed to the disk-like member 228, spaced circumferentially equidistant along the outer periphery 230, and extend axially, generally parallel to central axis A, between the lower end 66 and the upper end 64 of the basket 60, juxtaposed in relatively close proximity to the side wall 62. An annular brace 236 is affixed to the upper tips 238 of the impeller blades 232 to complete a relatively rigid assembly which, when rotated about central axis A, assists in moving the mixture through the slots 70 in the side wall 62 to increase the volumetric flow, or throughput, of the mixture.

In addition to the impeller blades 232, which extend axially upwardly from the disk-like member 228, a plurality of mixing blades 240 are spaced circumferentially along the outer periphery 230 of the disk-like member 228 of the rotor 224 and depend axially downwardly from the disk-like member 228 to enhance mixing as the mixture is circulated. The mixing blades 240 are relatively short in the axial direction in comparison to the impeller blades 232, and while they may be placed along the disk-like member 228 either within or without the diametral dimension of the side wall 62 of the basket 60, or both within and without the diametral dimension of the side wall 62, the mixing blades 240 are shown located in the preferred location outside the diametral dimension of the side wall 62 of the basket 60. The disk-like member 228 preferably is imperforate so as to assure that circulation of the mixture is confined to generally radial directions, as the mixture passes through the side wall 62. In addition, the solid configuration of the disk-like member 228 segregates the mixing blades 240 from the impeller blades 232 so that the mixing blades 240 do not affect the flow of the mixture in the generally radial directions, as imparted by the impeller blades 232. The mixing blades 240 enhance the ability to incorporate dry materials within the mixture in the mixing vessel 12 without the necessity for additional pre-wetting or pre-mixing.

It will be seen that the improvement of the present invention attains the several objects and advantages summarized above, namely: Increases the rate at which the mixture is circulated through the basket, and through the bed of media in the basket, for more rapid grinding and dispersion of the solids in the liquid; enhances the ability to circulate higher viscosity mixtures; attains the dispersion of more finely divided solids in a liquid vehicle in less time; increases agitation of the mixture within the mixing vessel, outside the basket, for improved homogeneity of the mixture; enables effective grinding and dispersion of solids which heretofore have resisted efficient grinding and mixing with liquids; increases the efficiency with which solids are finely divided and dispersed in a liquid vehicle, thereby reducing energy requirements; attains mixtures of enhanced and uniform quality with less processing time; enhances the ability to incorporate dry materials into the mixture without requiring additional pre-wetting or pre-mixing; reduces clogging and other detrimental effects, thereby attaining more effective operation; increases the service life of the apparatus through reduced wear and either the reduction or elimination of other deleterious conditions.

It is to be understood that the above detailed description of preferred embodiments of the invention is provided by way of example only. Various details of design and construction may be modified without departing from the true spirit and scope of the invention, as set forth in the appended claims.

The embodiments of the invention in which an exclusive property or privilege is claimed are defined as follows:

1. In a media basket mill for dispersing a selected constituent into a liquid vehicle to produce a mixture of the constituent and the liquid vehicle within a mixing vessel, the media basket mill including a basket extending in an axial direction between a upper end and a lower end, a media bed in the basket, and impeller means, the basket having a wall for retaining the media bed within the basket and openings in the wall for permitting passage of the mixture through the wall in response to operation of the impeller means when the basket is immersed in the mixture in the vessel, the wall including a bottom wall portion at the bottom end and an axially extending side wall portion having an overall diametral dimension, the openings being located at least in the side wall portion, an improvement wherein:

the impeller means includes a rotor for rotation about the axial direction, and impellers on the rotor, the impellers being located radially outwardly beyond the diametral dimension of the side wall portion of the wall of the basket for assisting in the movement of the mixture through the openings in the side wall portion and within the mixing vessel outside the basket in response to rotation of the rotor.

2. The improvement of claim 1 wherein some of the openings are located in the bottom wall portion, the rotor is located adjacent the bottom wall portion, axially outside the lower end of the basket, and the impeller means includes impeller blades having inner blade portions juxtaposed with the bottom wall portion and extending radially outwardly within the diametral dimension of the side wall portion for assisting in the movement of the mixture through the openings in the bottom wall portion, and outer blade portions extending radially outwardly beyond the diametral dimension of the side wall portion for assisting in the movement of the mixture through the openings in the side wall portion of the basket and within the mixing vessel outside the basket.

3. The improvement of claim 2 wherein the outer blade portions extend axially upwardly adjacent the side wall portion toward the upper end of the basket and are juxtaposed with the side wall portion along at least a major portion of the axial extent of the side wall portion for assisting in the movement of the mixture through the openings in the side wall portion of the basket and within the mixing vessel outside the basket.

4. The improvement of claim 3 wherein the outer blade portions extend axially from adjacent the lower end of the basket to adjacent the upper end of the basket.

5. The improvement of claim 1 wherein the side wall portion is cylindrical and has a central axis extending between the upper end and the lower end of the basket, and the rotor is mounted for rotation about the central axis.

6. The improvement of claim 5 wherein some of the openings are located in the bottom wall portion, the rotor is located adjacent the bottom wall portion, axially outside the lower end of the basket, and the impeller means includes impeller blades having inner blade portions juxtaposed with the bottom wall portion and extending radially outwardly within the diametral dimension of the side wall portion for assisting in the movement of the mixture through the openings in the bottom wall portion, and outer blade portions extending radially outwardly beyond the diametral dimension of the side wall portion for assisting in the movement of the mixture through the openings in the side wall portion of the basket and within the mixing vessel outside the basket.

7. The improvement of claim 6 including a cylindrical shroud depending axially downwardly beyond the bottom wall portion and interposed radially between the inner blade portions and the outer blade portions.

8. The improvement of claim 6 wherein the outer blade portions extend axially upwardly adjacent the side wall portion toward the upper end of the basket and are juxtaposed with the side wall portion along at least a major portion of the axial extent of the side wall portion for assisting in the movement of the mixture through the openings in the side wall portion of the basket and within the mixing vessel outside the basket.

9. The improvement of claim 8 wherein the outer blade portions extend axially from adjacent the lower end of the basket to adjacent the upper end of the basket.

10. The improvement of claim 9 including a cylindrical shroud depending axially downwardly beyond the bottom wall portion and interposed radially between the inner blade portions and the outer blade portions.

11. The improvement of claim 1 wherein the rotor is located adjacent the bottom wall portion, axially outside the lower end of the basket, and the impeller means includes impeller blades having outer blade portions extending radially outwardly beyond the diametral dimension of the side wall portion for assisting in the movement of the mixture through the openings in the side wall portion of the basket and within the mixing vessel outside the basket.

12. The improvement of claim 11 wherein the outer blade portions extend axially upwardly adjacent the side wall portion toward the upper end of the basket and are juxtaposed with the side wall portion along at least a major portion of the axial extent of the side wall portion for assisting in the movement of the mixture through the openings in the side wall portion of the basket and within the mixing vessel outside the basket.

13. The improvement of claim 12 wherein the outer blade portions extend axially from adjacent the lower end of the basket to adjacent the upper end of the basket.

14. The improvement of claim 11 wherein the bottom wall portion is essentially imperforate.

15. The improvement of claim 14 wherein the outer blade portions extend axially upwardly adjacent the side wall portion toward the upper end of the basket and are juxtaposed with the side wall portion along at least a major portion of the axial extent of the side wall portion for assisting in the movement of the mixture through the openings in the side wall portion of the basket and within the mixing vessel outside the basket.

16. The improvement of claim 15 wherein the outer blade portions extend axially from adjacent the lower end of the basket to adjacent the upper end of the basket.

17. The improvement of claim 11 including mixing blades on the rotor and extending downwardly axially away from the bottom wall portion of the basket.

18. The improvement of claim 17 wherein the mixing blades are located radially beyond the diametral dimension of the side wall portion of the basket.

19. The improvement of the claim 18 wherein the rotor comprises a disk-like member.

20. The improvement of claim 11 wherein the side wall portion is cylindrical and has a central axis extending between the upper end and the lower end of the basket, and the rotor is mounted for rotation about the central axis.

21. The improvement of claim 20 wherein the outer blade portions extend axially upwardly adjacent the side wall portion toward the upper end of the basket and are juxtaposed with the side wall portion along at least a major portion of the axial extent of the side wall portion for assisting in the movement of the mixture through the openings in the side wall portion of the basket and within the mixing vessel outside the basket.

22. The improvement of claim 21 wherein the outer blade portions extend axially from adjacent the lower end of the basket to adjacent the upper end of the basket.

23. The improvement of claim 20 wherein the bottom wall portion is essentially imperforate.

24. The improvement of claim 23 wherein the outer blade portions extend axially upwardly adjacent the side wall portion toward the upper end of the basket and are juxtaposed with the side wall portion along at least a major portion of the axial extent of the side wall portion for assisting in the movement of the mixture through the openings in the side wall portion of the basket and within the mixing vessel outside the basket.

25. The improvement of claim 24 wherein the outer blade portions extend axially from adjacent the lower end of the basket to adjacent the upper end of the basket.

26. The improvement of claim 20 including mixing blades on the rotor and extending downwardly axially away from the bottom wall portion of the basket.

27. The improvement of claim 26 wherein the mixing blades are located radially beyond the diametral dimension of the side wall portion of the basket.

28. The improvement of the claim 27 wherein the rotor comprises a disk-like member.

* * * * *